US005833018A

United States Patent [19]

von Gynz-Rekowski

[11] Patent Number: 5,833,018

[45] Date of Patent: Nov. 10, 1998

[54] DRILL PIPE/CASING PROTECTOR

[75] Inventor: Gunther von Gynz-Rekowski, Houston, Tex.

[73] Assignee: Pegasus International Inc., Cayman Islands

[21] Appl. No.: 770,517

[22] Filed: Dec. 20, 1996

[51] Int. Cl.[6] ..... E21B 17/10

[52] U.S. Cl. ..... 175/325.3; 175/325.1; 175/325.5; 166/241.4; 166/241.6

[58] Field of Search ..... 175/325.3, 325.5, 175/325.1; 166/241.3, 241.4, 241.6

[56] References Cited

U.S. PATENT DOCUMENTS

| | | |
|---|---|---|
| 2,079,449 | 5/1937 | Haldeman . |
| 2,308,316 | 1/1943 | Smith et al. . |
| 2,318,878 | 5/1943 | Miller . |
| 2,368,415 | 1/1945 | Grant . |
| 2,572,307 | 10/1951 | Brown et al. . |
| 2,650,798 | 9/1953 | Stohn . |
| 2,715,552 | 8/1955 | Lane . |
| 2,813,697 | 11/1957 | Swart . |
| 2,829,864 | 4/1958 | Knapp . |
| 2,860,013 | 11/1958 | Medearis . |
| 3,063,759 | 11/1962 | Moore et al. . |
| 3,088,532 | 5/1963 | Kellner . |
| 3,154,156 | 10/1964 | Moore et al. . |
| 3,227,498 | 1/1966 | Leathers . |
| 3,320,004 | 5/1967 | Garrett . |
| 3,397,017 | 8/1968 | Grant et al. . |
| 3,410,613 | 11/1968 | Kuus . |
| 3,419,094 | 12/1968 | Bobo . |
| 3,425,757 | 2/1969 | Minor . |
| 3,449,022 | 6/1969 | Minor . |
| 3,476,196 | 11/1969 | Whittle et al. . |
| 3,480,094 | 11/1969 | Morris . |
| 3,482,889 | 12/1969 | Cochran . |
| 3,499,210 | 3/1970 | Schellstede et al. . |
| 3,525,825 | 8/1970 | Allison . |
| 3,528,499 | 9/1970 | Collett . |
| 3,588,199 | 6/1971 | Hopmans . |
| 3,592,515 | 7/1971 | Grant . |
| 3,630,634 | 12/1971 | Mayall ..... 415/170 |
| 3,667,817 | 6/1972 | Kellner . |
| 3,675,728 | 7/1972 | Faulk et al. . |
| 3,709,569 | 1/1973 | Napper . |
| 3,894,779 | 7/1975 | Hoon et al. . |
| 3,894,780 | 7/1975 | Broussard . |
| 3,933,395 | 1/1976 | Evans . |
| 3,999,811 | 12/1976 | Gray . |

(List continued on next page.)

FOREIGN PATENT DOCUMENTS

WO 95/10685 4/1995 WIPO .

OTHER PUBLICATIONS

Rodman, David williams, et al., Drillstring sub cuts torque and casing wear, *Oil & Gas Journal*, Oct. 1996, 64–72.

Bettis Rubber Products Bulletin, 1993, 1–13.

Regal Drill Pipe/Casing Protectors, date unknown, 4 pages.

Weatherford Enterra, Drill/Pipe casing Protectors, Aug. 8, 1996, 2 page.

Extending Horizontal Drilling Reach, *Journal of Petroleum Technology*, Aug. 1996, 738–740.

*Primary Examiner*—Tamara L. Graysay
*Assistant Examiner*—Gary S. Hartmann
*Attorney, Agent, or Firm*—Rosenblatt & Redano, P.C.

[57] ABSTRACT

A non-rotating drill pipe/casing protector is disclosed. The protector has a bi-directional thrust bearing which can be mounted uphole or downhole from the protector. The bi-directional thrust bearing comprises a female and male part where the female is fixed to the tube and the male can relatively rotate with respect to the pipe. The protector has an insert which extends longitudinally out of the sleeve and is used as the male component in the thrust bearing. Thrust loads are absorbed by metallic component contact, thereby eliminating edge wear of the non-rotating sleeve. The thrust bearing components may have wear pads that are replaceable. Roller bearings can also be used to facilitate the relative rotation between the drillpipe and the sleeve. Wear pads can also be employed on the outside of the sleeve to increase its life.

20 Claims, 5 Drawing Sheets

U.S. PATENT DOCUMENTS 4,059,164 11/1977 Farris .
4,071,101 1/1978 Ford .
4,083,612 4/1978 Olson .
4,108,256 8/1978 Moore, III .
4,199,853 4/1980 Fricker .
4,220,213 9/1980 Hamilton .
4,266,578 5/1981 Swain et al. .
4,284,154 8/1981 England .
4,372,622 2/1983 Cheek .
4,381,821 5/1983 Greene, Jr. .
4,384,625 5/1983 Roper et al. .
4,384,747 5/1983 Hodge .
4,394,881 7/1983 Shirely .
4,399,876 8/1983 Tienari .
4,484,785 11/1984 Jackson .
4,665,996 5/1987 Foroulis et al. .
4,665,997 5/1987 Maurer et al. .
4,715,453 12/1987 Falgout, Sr. et al. ..... 175/73
4,796,670 1/1989 Russell et al. .
4,823,891 4/1989 Hommani et al. .
4,825,964 5/1989 Rives ..... 175/371
4,832,137 5/1989 Walker .
4,865,138 9/1989 Swietlik .
4,907,661 3/1990 Lloyd .
4,995,466 2/1991 Snow, Jr. .
5,052,501 10/1991 Wenzel et al. .
5,058,689 10/1991 Collinsworth .
5,069,297 12/1991 Krueger et al. .
5,090,500 2/1992 Yousef et al. .
5,117,927 6/1992 Askew .
5,174,679 12/1992 Wolf .
5,261,498 11/1993 Steinkamp et al. ..... 175/325.3
5,339,910 8/1994 Mueller .
5,458,208 10/1995 Clarke .

DRILL PIPE/CASING PROTECTOR

FIELD OF THE INVENTION

The field of this invention relates to tube, drill pipe and casing protectors, particularly of the type that allows the tube or drill pipe to rotate relative to the protector when the protector encounters the casing or the wellbore.

BACKGROUND OF THE INVENTION

Wells are typically drilled by using a drillbit connected to a string which is rotated from the surface. In drilling deviated wellbores, the drillstring can contact the wellbore or casing, thereby causing wear to the surrounding casing, the pipe segments making up the drillstring, or the joints holding them together. In some applications like in deep and extended reach wells, very high torques are required for drill string rotation.

In order to protect both components the pipe and the casing from wear and in order to reduce the rotary torque required at the rotary table, various devices have been used in the past. One type of protector is rigidly secured to the drillpipe. This design can involve a flexible sleeve that is forced over a stand of drillpipe, or it can involve a split design that is mounted over the stand of drillpipe, which generally has a cage with overlapping loops that are held together to the drillpipe by insertion of a tapered pin when the loops are aligned around the pipe. These types of devices are generally illustrated in U.S. Pat. Nos. 3,709,569; 3,425,757; 3,592,515; 3,588,199; 3,480,094; 3,667,817; and 3,675,728. Some of these designs are also intended to allow the drillstring to rotate when the protector engages the wellbore or casing. For example, U.S. Pat. No. 3,675,728 illustrates a stabilizer, which is longitudinally unrestrained and is free to allow the drillpipe to continue rotating when it engages the wellbore or casing. A similar design is illustrated in U.S. Pat. No. 5,069,297 (the"'297 patent"). This patent illustrates the technique of longitudinal restraint by using pairs of bolted half-rings above and below a sleeve, which is otherwise rotatably mounted with respect to the drillpipe that passes through it. Such designs are similarly illustrated in U.S. Pat. No. 4,907,661; British specification 2,04895; and PCT application PCT/GB94/02236. The latter reference illustrates the use of sleeve type bearings mounted adjacent the sleeve to facilitate relative axial rotation with respect to the drillpipe and also to act as a component of the thrust bearing in the event that contact with the casing or wellbore puts a longitudinal load on the sleeve.

The designs reflected in the '297 patent are marketed by Western Well Tool of Costa Mesa, Calif., as non-rotating drill pipe protectors. One of the problems with such prior non-rotating protector designs, as illustrated in the '297 patent, can be seen by examination of FIG. 1 which illustrates the prior art after some degree of use in the wellbore. The sleeve is generally designated as 10 and the casing is designated as 12. The drillpipe 14 supports split rings 16 which, on the one end shown, act as a thrust bearing for the sleeve 10. The material of the sleeve 10 is softer than the material of the split ring 16. (A similar pair of split rings are located at the opposite end, which is not shown.) As the sleeve 10 wears by contact with the casing 12, thrust loads transmitted through the sleeve 10 against the thrust bearing 16 ultimately cause the split rings 16 to dig and wear into the sleeve 10, as shown by comparing the left-hand and right-hand segments of FIG. 1. On the left side of FIG. 1, the sleeve 10 has a taper 18 which extends into a groove 20 in the split rings 16. As the sleeve 10 is forced up against the thrust bearing made by split rings 16, a notch 22 develops in the top of the sleeve 10, creating a sharp point 24 which faces uphole. Shown schematically in FIG. 1 are resilient components of a blowout preventer assembly 26. Thus, when the drillpipe 14 is pulled out of the hole, the sharp point 24 engages the components 26 of the BOP assembly, or any other projections within the wellbore, causing either damage to such components or potentially making extraction of the drillstring 14 more difficult as sharp point 24 snags or hook on such objects. As a result, the prior design protector in FIG. 1 is destroyed and could also fall in the hole.

A completely different technique using individual short sections of pipes, called subs, that have a non-rotating metal protector mounted to them have been employed by the Security DBS division of Dresser Industries Inc. This product has been described in the Aug. 1996 edition of the *Journal of Petroleum Technology*, pp. 738–740, and is also described in a new product release by Security DBS entitled "Drillstring Torque Reduction Sub." The same product is also described in the *Oil & Gas Journal* issue of Oct. 14, 1996, p. 64. This product has a combination of ball and roller bearings mounted to a sleeve, held onto a separate sub by upper and lower retainer rings which bear against the sleeve. Upper and lower seals are provided to keep the circulating cuttings out of the bearing area. Employing this design involves the use of many more joints in the drillstring, which creates a concern of the integrity of the string plug lengthens the make-up time for the string. The construction of the torque-reduction sub is particularly complex, making the cost of using a multiplicity of such subs in a given string fairly high. Once this joint wears, there will be contact between the sleeve and the retainer ring which can cause the product to fail and fall in the hole or damage other well components during removal.

Accordingly, one of the objectives of the present invention is to provide a simple, reliable design for a non-rotating pipe protector that overcomes the problems previously described. The net result of the invention is to provide a non-rotating protector that has a simply designed bi-directional thrust bearing and can be very easily assembled on the tube or pipe. One of the components of the thrust bearing, is contained in part in the non-rotating sleeve such that axial loads imparted on the sleeve result in wear of metallic wear-away components rather than the sleeve itself. In the same matter, this thrust bearing component will function as a skeleton for the sleeve. Apart from the unique bi-directional thrust bearing design, another object of the invention is to improve the performance of the sleeve in reaction to radial loads, which is accomplished by the use of one or more roller bearings.

SUMMARY OF THE INVENTION

A non-rotating drill pipe/casing protector is disclosed. The protector has a bi-directional thrust bearing which can be mounted uphole or downhole from the protector. The bi-directional thrust bearing comprises a female and male part where the female is fixed to the tube and the male can relatively rotate with respect to the pipe. The protector has an insert which extends longitudinally out of the sleeve and is used as the male component in the thrust bearing. Thrust loads are absorbed by metallic component contact, thereby eliminating edge wear of the non-rotating sleeve. The thrust bearing components may have wear pads that are replaceable. Roller bearings can also be used to facilitate the relative rotation between the drillpipe and the sleeve. Wear pads can also be employed on the outside of the sleeve to increase its life.

DETAILED DESCRIPTION OF THE PREFERRED EMBODIMENT

Figure 1:
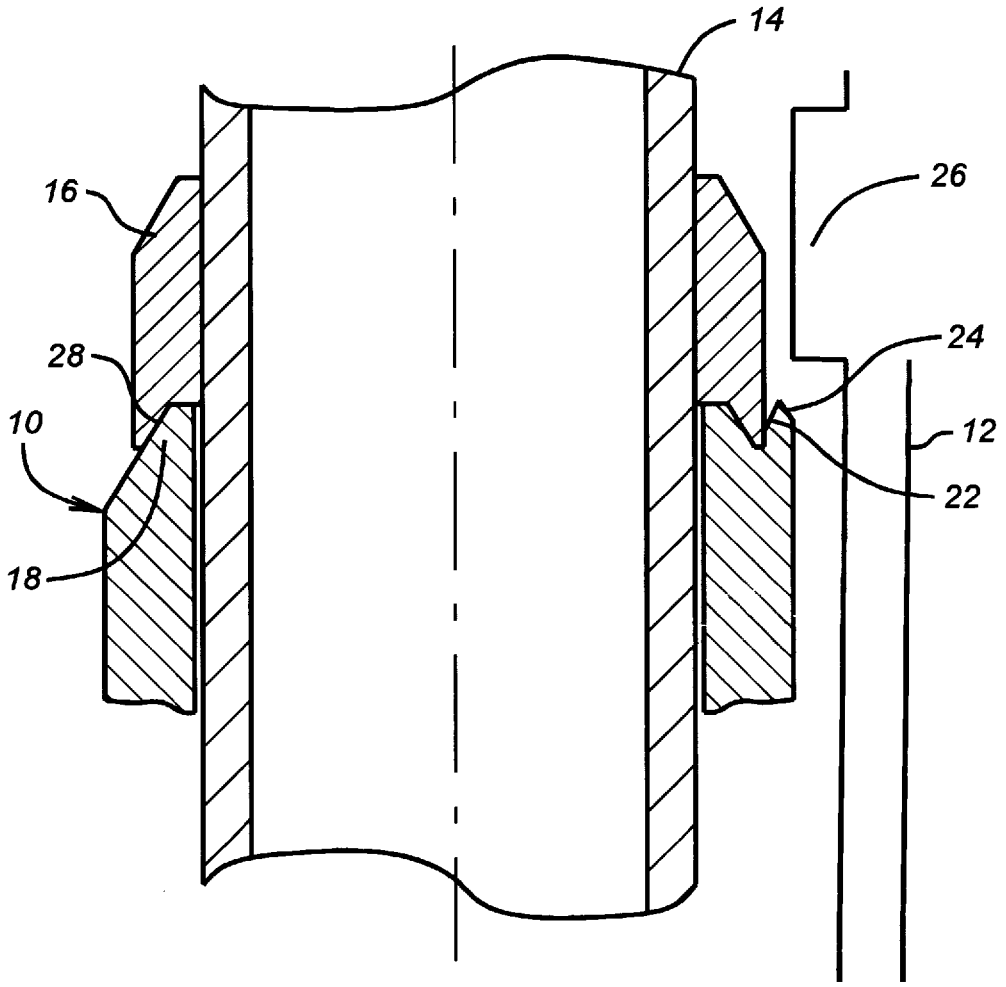
(PRIOR ART) FIG. 1
FIG. 1 is a sectional view of a prior art design, illustrating its wear patterns.
Figure 2:
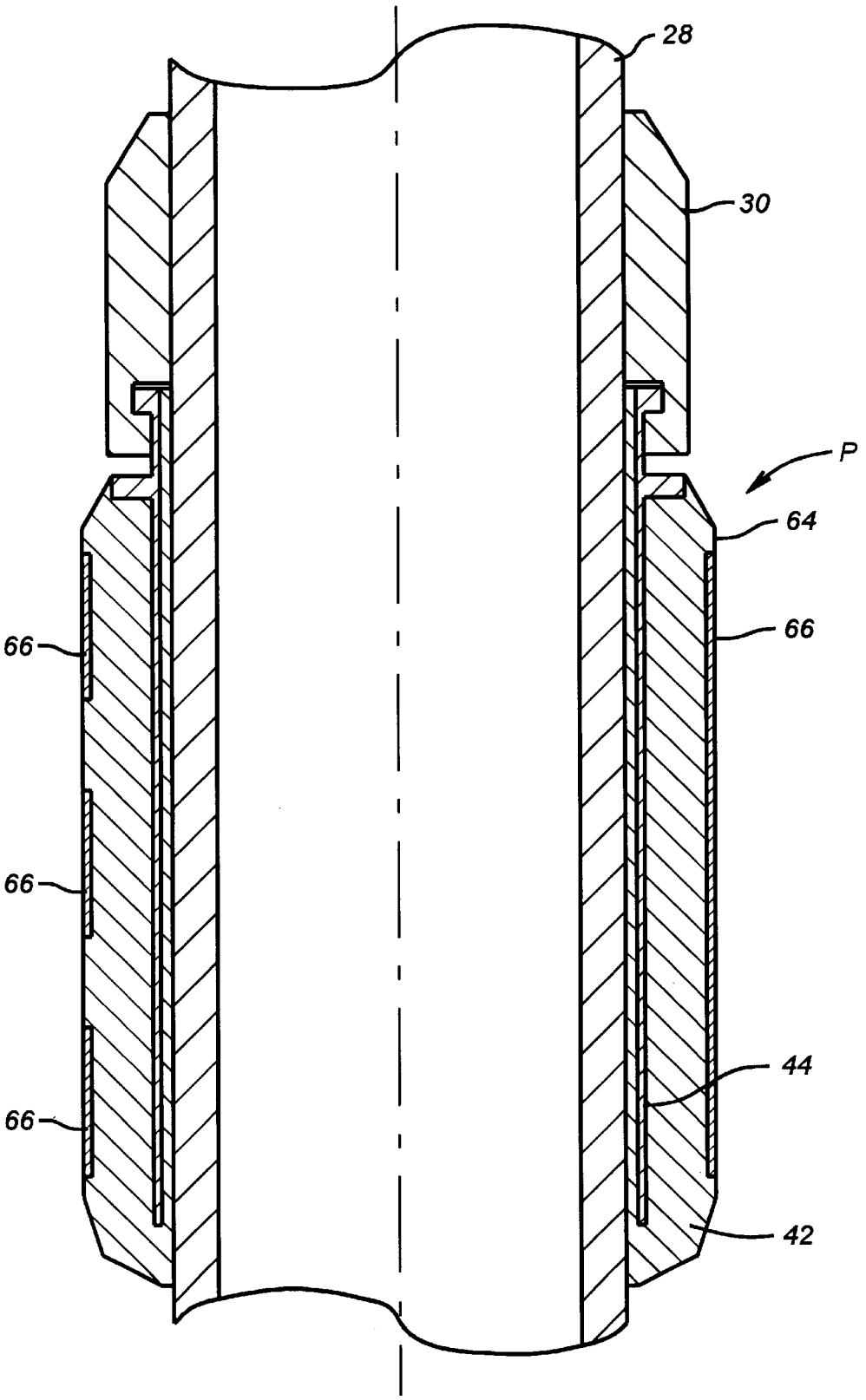
FIG. 2 is a sectional elevational view of the present invention.
Figure 3:
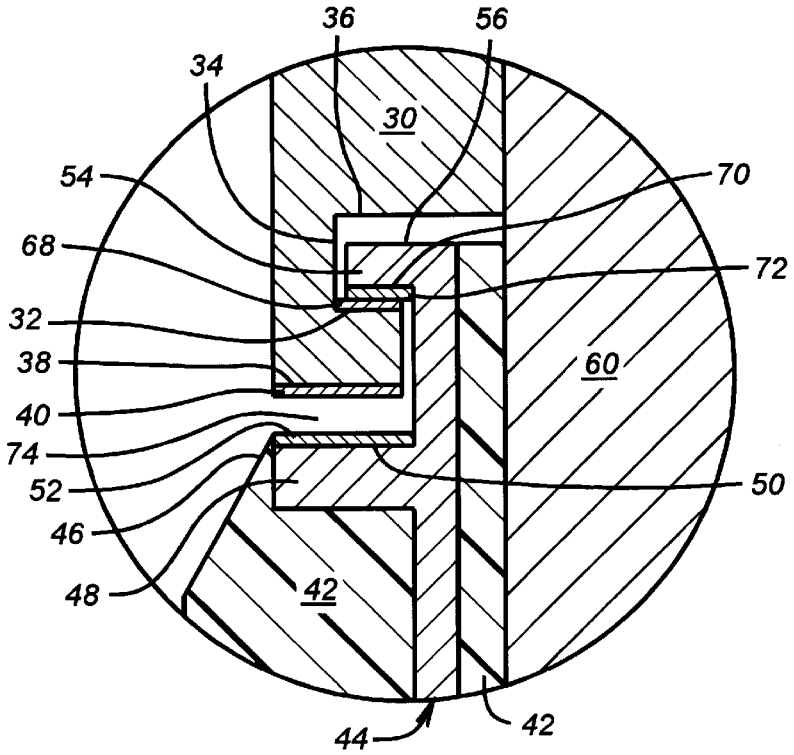
FIG. 3 is a detail of the thrust bearing shown mounted above the sleeve and in the position where a downhole force is applied to the sleeve.
Figure 4:
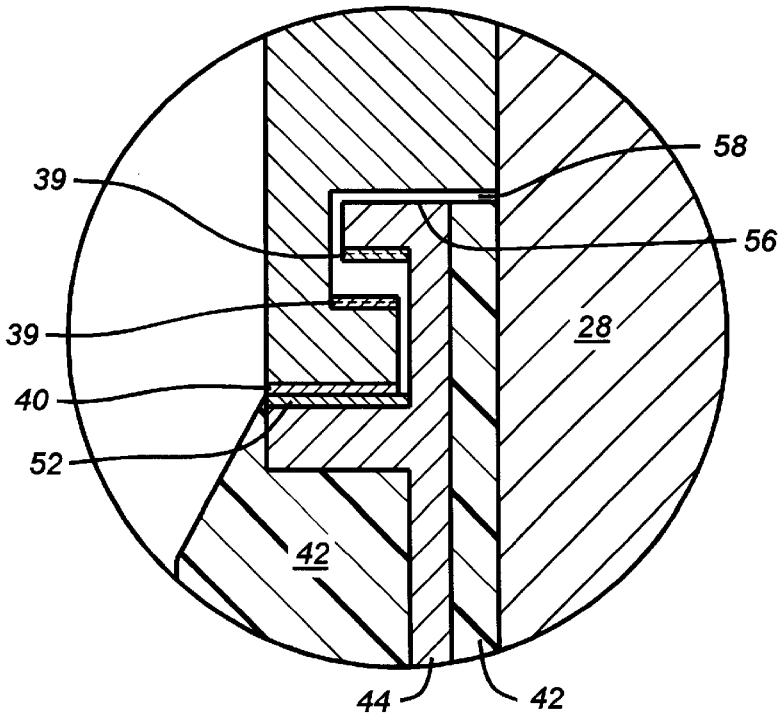
FIG. 4 is the bearing shown in FIG. 3, with the thrust forces reversed.

The non-rotating protector P is illustrated in FIG. 2. The drillpipe 28 supports split collar 30. Split collar 30 has two pieces that are bolted, screwed, or clamped together. The bolts, the threads, the clamps are not shown in FIG. 2. Split collar 30 has an internal shoulder 32 adjacent surfaces 34 and 36 (see FIG. 3). Radial surface 38 is covered by the wear pad 40. The sleeve 42 has a cage 44 extending therethrough, as shown in FIGS. 2 and 3. The cage 44 is a rigid reinforced member which is attached to and stiffens the sleeve and additionally handles the radial and axial bearing function. In other words there is now load transmission throughout the sleeve 42 which transfers mechanical wear to a location other than the OD wear of the sleeve itself. The sleeve 42 itself see's only OD wear no shoulder wear. The cage 44 extends beyond the upper end 46 of sleeve 42. Cage 44 has a radially extending tab 48 on which is found radial surface 50. Wear pad 52 is mounted in opposed orientation with wear pad 40 for eventual contact in response to loads applied to the sleeve 42 when in contact with the casing or borehole (not shown) such that a longitudinal force in an uphole direction is applied to sleeve 42 which will be happen when drilling or tripping in the hole. This condition is depicted in FIG. 4. Wear pad 52 and wear pad 40 can be made of one singular ring structure or of multiple segments.

The cage 44 has a tab 54 which defines an annularly shaped radial top surface 56. As seen in FIG. 4, when the wear pads 40 and 52 make contact, a gap 58 exists between surface 56 and surface 36, which is part of split collar 30. Thus, when an uphole force is delivered to the sleeve 42, while the drill pipe 28 is rotating, wear pads 40 and 52 contact each other to absorb the thrust load. The cage 44 can be hinged (not shown) in an effort to allow easy installation because the open-end could not be easily spread to go around the pipe if a hinge isn't used. The cage 44 can also have a wavy fluted or corrugated appearance (not shown) and openings like holes and slots (not shown) to enhance the bonding effect of other materials to the cage 44. The sleeve 42 can be made of heat resistant nitrile rubber or polyurethane. The split collar 30 can be made of steel, aluminum or zinc alloy.

Referring to FIG. 2, the sleeve 42 has an outer surface 64 which can contain a series of elongated wear pads 66. The pads 66 can also be in segmented form, as shown on the left-hand portion of FIG. 2. Thus, the outer surface 64 can be substantially covered with a wear sleeve 66 or with longitudinal segments serving as wear pads 66, or even split circumferential bands, as illustrated on the left-hand side of FIG. 2 as an alternative embodiment.

Referring again to FIG. 3, it can be seen that the split collar 30 has a wear pad 68 mounted to shoulder 32. The cage 44 comprises radial surface 70 on which is mounted a wear pad 72. When downhole thrust forces are applied to the sleeve 42, the wear pads 68 and 72 connect, as shown in FIG. 3, such that relative rotation exists as the movement of the sleeve 42 stops when it encounters the casing and the split ring or collar 30 continues to rotate because it is connected to the drillpipe 60. Wear pad 68 and wear pad 70 can be made of one singular ring structure or of multiple segments.

When the sleeve 42 is subjected to a longitudinal force in a downhole direction, as illustrated in FIG. 3, a gap 74 exists as wear pads 72 and 68 make contact. By virtue of the gap 74, shown in FIG. 3, and gap 58, shown in FIG. 4, the sleeve 42 does not come into rubbing contact with a metallic component such as the split collar 30. The wear pads, such as 38, 68, 70, and 52, can be formed from any variety of materials depending on the particular well application and the durability that is desired. To some extent, the circulating drilling fluids in the annular space will facilitate lubrication and removal of heat generated due to the mating rotating contact between pairs of wear pads as previously described. Additional grooves 39 which are placed in the mating surfaces of the wear pads 38, 68, 70, and 52 will support the lubrication and heat removal.

Figure 5:
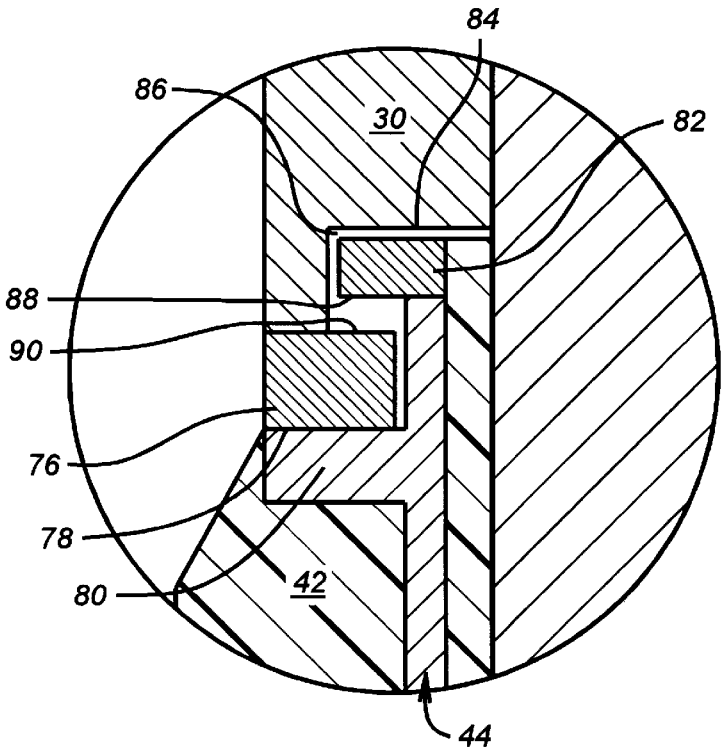
FIG. 5 is an alternative embodiment to FIGS. 3 and 4.

FIG. 5 illustrates an alternative embodiment wherein the split collar 30 is of a nonrenewable design featuring an integral wear pad 76 that rubs directly on radial surface 78 of tab 80, which is part of the cage 44. The top of the cage 44 has an integral wear pad 82 which opposes radial surface 84 and forms a clearance 86 when wear pad 76 contacts surface 78, as illustrated in FIG. 5. This occurs when the sleeve 42 is subjected to a longitudinal load in an uphole direction. Wear pad 76 and wear pad 82 can be made of one singular ring structure or of multiple connected segments. When the load on sleeve 42 is reversed, the cage 44 with sleeve 42 moves downwardly until surfaces 88 and 90 connect to resist loads placed on the sleeve 42 in a downhole direction. Again, in this embodiment, the cage 44 is part of the bi-directional thrust bearing and, in conjunction with split collars 30, forms the balance of the bi-directional thrust bearing. Under load, the thrust bearing assembly wears by design while protecting the softer rubber or other resilient component used to make sleeve 42 from direct contact with the thrust bearing components, thereby minimizing the wear from thrust loading on sleeve 42.

The relative rotation between the drillpipe 28 and the sleeve 42 can be improved by use of bearings or bearing segments 92 and 94. Each of the bearings 92 and 94 are preferably of the roller type, split into two 180° components and retained by cages 96 and 98, respectively. The bearing cages 96 and 98 with are interposed between the cage 44 of the sleeve 42 and the pipe 28 function as planet gears relatively to the sleeve 42 which acts as an outer ring and the pipe 28 which acts as a sun gear of a planetary train. That means the non-rotating pipe protector system is actually a friction driven planetary train. The cages 96 and 98 which connect the balls or rollers are the arm of the planetary train systems. Therefore, the rotating torque will be even more reduced by an amount of approximately 10–20% due to the rolling movement as compared to frictional sliding movement. The seal 110 which is placed in the ID of the shoulder of the sleeve 42 in opposite to the split rings 30 will reduce cuttings and mud flowing between the pipe 28 and the sleeve 42.

Figure 7:
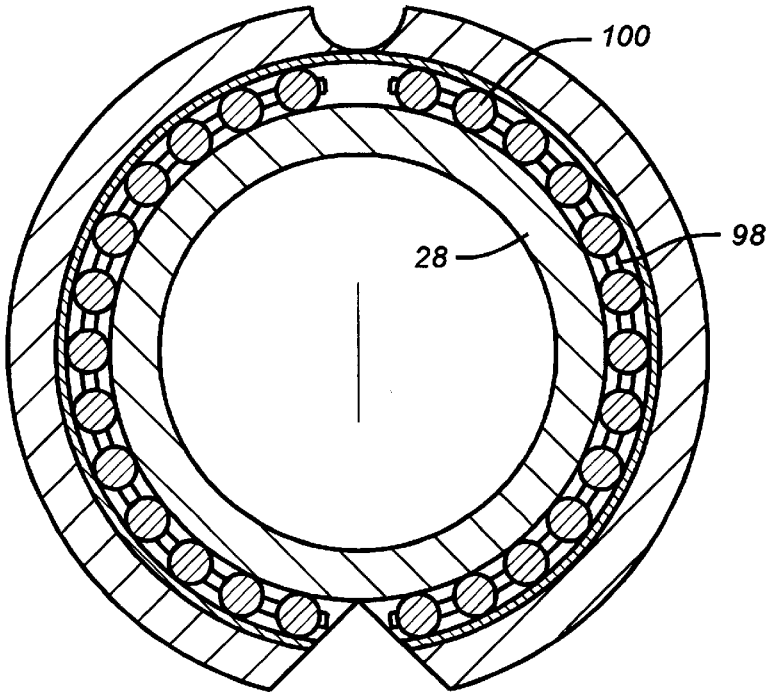
FIG. 7 is the view along line 7—7 of FIG. 6.

FIG. 7 shows a cross-section through one of the bearings illustrating the use of rollers 100 against the drillpipe 28. The bearing cages 98 which are interposed between the cage 44 of the sleeve 42 and the pipe 28 are illustrated in FIG. 7.

Figure 6:
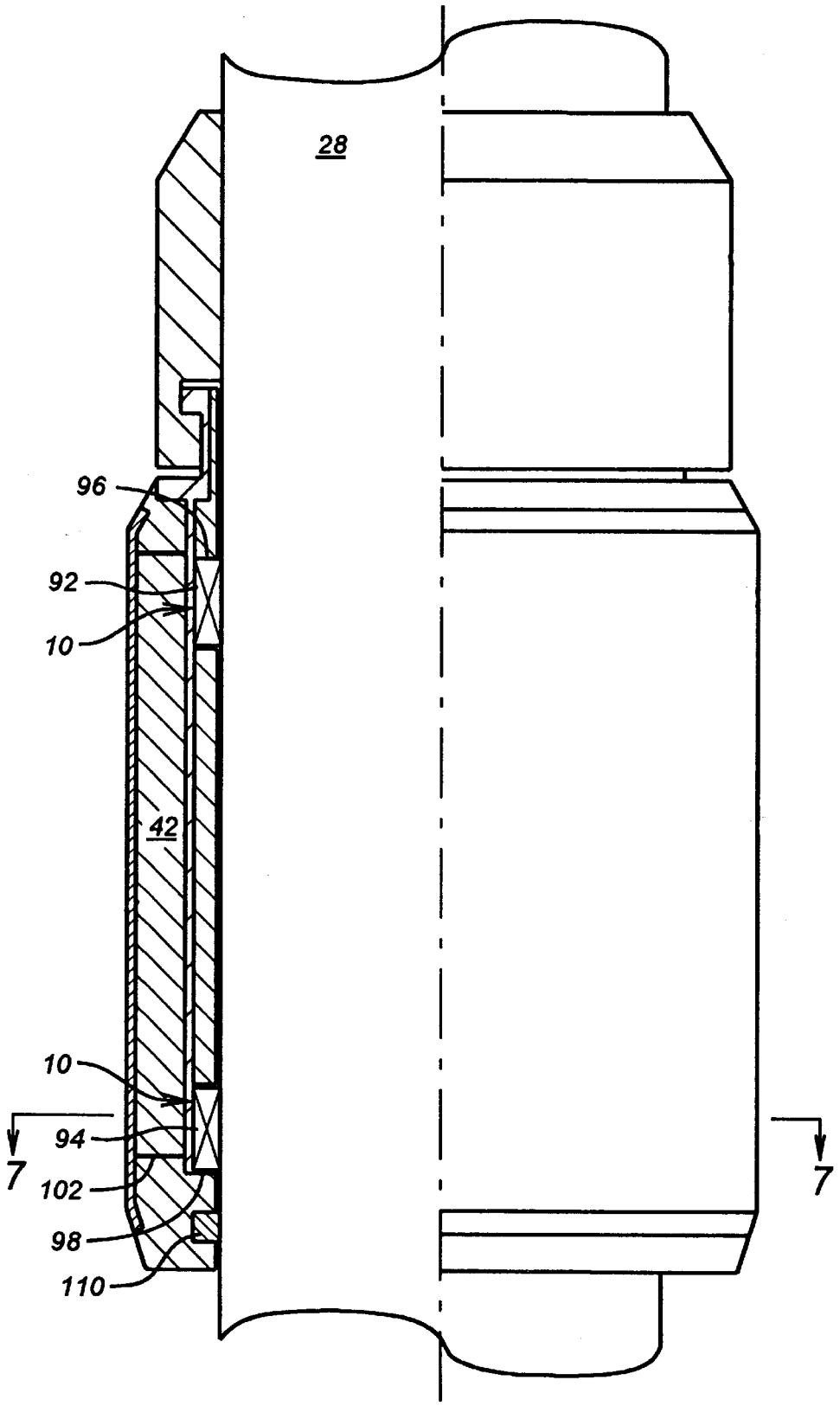
FIG. 6 is a part sectional view showing the thrust bearing as well as roller bearings used in combination.

Those skilled in the art will now appreciate that the illustrated design for a non-rotating protector describes features which present a clear improvement over prior designs. The illustrated design of the preferred embodiment is an economical construction which, if used with the wear pads as shown in FIGS. 3 and 4, facilitates reuse upon renewal of the wear pads. The thrust loads are conveyed from the sleeve 42 directly into the thrust bearing assembly illustrated in FIGS. 3, 4, or 5, and the sleeve material is protected from contact with the thrust bearing components. The cage 44, which is provided to give strength to the sleeve 42 and to be used in securing the sleeve 42 around the drillpipe 28, also acts as the conduit for longitudinal forces in both directions. The thrust bearing assembly can be used above the sleeve 42, as shown in FIG. 2, or it could be used below the sleeve 42 without departing from the spirit of the invention. If desired, the thrust bearing can be made unidirectional and a pair of thrust bearings employed above and below the sleeve 42, using a construction where the cage 44 extends outwardly from both ends of the sleeve 42 to form a portion of two thrust bearings located at opposite ends, each functioning to resist a thrust load in an opposite direction from the other. The wear pads 66, as shown in FIG. 2, can be secured to the cage 44, as shown schematically in FIG. 6, using ties 102.

The illustrated design of the preferred embodiment is also a construction which, if used will reduce the time to install the non-rotating pipe protector by 50% compared to presently utilized designs.

The amount of initial clearance between the drillpipe 28 and the sleeve 42 can be varied according to the application, as well as the construction dimensionally of the bi-directional thrust bearing illustrated in FIGS. 3 and 4. The sleeve 42 can also have internal liners which can wear preferentially before the actual material of sleeve 42 wears on its internal diameter.

The foregoing disclosure and description of the invention are illustrative and explanatory thereof, and various changes in the size, shape and materials, as well as in the details of the illustrated construction, may be made without departing from the spirit of the invention.

I claim:

1. A protector for a pipe disposed in a casing or wellbore, comprising:

a sleeve;

a cage mounted to said sleeve and extending beyond an end thereof;

a thrust bearing mounted to the pipe, a portion thereof comprising said cage, whereupon when a thrust load is transmitted to said sleeve from the casing or wellbore, said cage protects said sleeve from contact with another portion of said thrust bearing as the pipe rotates with respect to said sleeve and cage.

2. The protector of claim 1, wherein:

said cage protects said sleeve from contact with another portion of said thrust bearing when the pipe does not rotate with respect to said sleeve and cage.

3. The protector of claim 1, wherein:

said thrust bearing further comprises a collar having at least one first surface;

said cage has at least one first surface opposing said first surface on said collar to resist thrust in at least first direction.

4. The protector of claim 3, wherein:

said collar further comprises a second surface opposed to a second surface on said cage;

whereupon application of a thrust load on said sleeve in a first direction, said first surfaces contact and upon application of a thrust load on said sleeve in a second direction opposite said first direction, said second surfaces contact.

5. The protector of claim 1, wherein:

said thrust bearing further comprises a collar having a first radial surface;

said cage has a first radial surface opposing said first radial surface on said collar to resist thrust in a first direction.

6. The protector of claim 5, wherein:

said collar further comprises a second radial surface opposed to a second radial surface on said cage;

whereupon application of a thrust load on said sleeve in a first direction, said first radial surfaces contact and upon application of a thrust load on said sleeve in a second direction opposite said first direction, said second radial surfaces contact.

7. The protector of claim 1, wherein:

said thrust bearing limits longitudinal movement of said cage in more than one direction.

8. The protector of claim 7, wherein:

said thrust bearing limits longitudinal movement of said cage in two opposed directions.

9. The protector of claim 1, wherein:

said thrust bearing comprises at least one wear pad oriented to contact an opposed wear pad mounted to said cage so that said wear pads resist thrust in at least one direction.

10. The protector of claim 1, wherein:

said cage comprises a pair of spaced-apart tabs defining opposing wear surfaces;

said thrust bearing defining a tab mounted between said spaced-apart tabs on said cage, said tab on said thrust bearing comprising opposed thrust wear surfaces such that upon thrust loading on said sleeve in a first direction, one each of said opposing and thrust wear surfaces come in contact, while on application of a thrust on an opposite direction from said first direction, the other of said opposing and thrust wear surfaces are in contact.

11. The protector of claim 1, wherein:

said thrust bearing comprises a pair of spaced-apart tabs defining opposing wear surfaces;

said cage defining a tab mounted between said spaced-apart tabs on said thrust bearing, said tab on said cage comprising opposed thrust wear surfaces such that upon thrust loading on said sleeve in a first direction, one each of said opposing and thrust wear surfaces come in contact, while on application of a thrust on an opposite direction from said first direction, the other of said opposing and thrust wear surfaces are in contact.

12. The protector of claim 10, wherein:

at least one of said opposing and thrust wear surfaces have a wear pad thereon.

13. The protector of claim 12, wherein:

all said opposing and thrust wear surfaces further comprise a wear pad.

14. The protector of claim 12, wherein:

said wear pad comprises at least one groove in its face.

15. The protector of claim 1, wherein:

said sleeve further comprises at least one bearing mounted to said sleeve and disposed for contact with the pipe which said bearing counteracts radial loads at said sleeve.

16. The protector of claim 15, further comprising:

an upper and a lower radial bearing mounted to said sleeve; and at least one seal on said sleeve against the pipe to pump well fluids and cuttings away from said bearings.

17. The protector of claim 15, wherein:

said bearing comprises a plurality of rolling members enclosed by a segmented cage whereupon at least two segments are joined together to form said bearing.

18. The protector of claim 17, wherein:

said segmented cage can function as arm of a friction driven planetary train systems, said pipe can function as a sun gear of a friction driven planetary train, and said sleeve can function as outer ring of a friction driven planetary train.

19. The protector of claim 1, wherein:

said thrust bearing comprises two split segments that are assembled over the pipe and secured together so that said segments trap said cage in opposed directions for transmission of thrust loads bi-directionally.

20. The protector of claim 1, wherein:

said sleeve further comprises at least one wear pad on an outer face thereof for contact with the casing or borehole.

* * * * *